United States Patent [19]

Adams et al.

[11] 3,946,672

[45] Mar. 30, 1976

[54] ROCKET PROPELLED PROJECTILE

[75] Inventors: Gary V. Adams; Roy T. Minert; James R. Thurston, all of Brigham City, Utah

[73] Assignee: Thiokol Corporation, Newtown, Pa.

[22] Filed: Aug. 13, 1974

[21] Appl. No.: 497,020

[52] U.S. Cl. ..... 102/49.4; 102/7.2; 102/34.4; 102/37.6; 102/56 SC; 102/68; 102/69

[51] Int. Cl.[2] ..... F42B 13/50

[58] Field of Search ..... 102/7.2, 34.4, 35.6, 37.6, 102/49.4, 49.5, 56 SC, 68, 69, 78

[56] References Cited

UNITED STATES PATENTS

| | | | |
|---|---|---|---|
| 1,434,784 | 11/1922 | Lucas | 102/35.6 |
| 1,949,841 | 3/1934 | Nash | 102/78 |
| 3,101,052 | 8/1963 | Webster et al. | 102/37.6 |
| 3,491,689 | 1/1970 | Francois | 102/49.4 |
| 3,838,644 | 10/1974 | Prochnow et al. | 102/56 SC |
| 3,857,338 | 12/1974 | Bucklisch | 102/7.2 |

FOREIGN PATENTS OR APPLICATIONS

| | | | |
|---|---|---|---|
| 866,528 | 5/1941 | France | 102/35.6 |
| 1,208,220 | 12/1965 | Germany | 102/49.5 |

*Primary Examiner*—Verlin R. Pendegrass
*Attorney, Agent, or Firm*—Stanley A. Marcus; Edward E. McCullough; William R. Wright, Jr.

[57] ABSTRACT

The forward end of a rocket motor is attached, by a threaded adapter, to a cylindrical housing that is in turn attached to an elongated tube, the opposite end of which is fitted with a releasable nose cone. The elongated tube is filled with a series of bombs. Each bomb is a conical, shaped charge equipped at one end with a parachute protected by a split, conical, plastic shield loosely held together by a band and a pronged clip—all of which is seated in the conical recess of an adjacent bomb. A conical partition separates the tube from the housing; and the main parachute is attached in the housing. An acceleration actuated fuse in the adapter ignites a time delay charge, which ignites an explosive charge that when exploded forces a piston against the housing, so that it separates the housing and tube from the adapter and rocket. The piston is attached to the outer end of the main parachute, so that, as the piston is exposed at high velocity to the atmosphere, it becomes a means for deploying the main parachute. A perforated plate, packaged between the explosive charge and the piston, is attached by cable to the adapter and becomes a drogue to alter the trajectory of the spent rocket on its separation from the projectile.

5 Claims, 4 Drawing Figures

ROCKET PROPELLED PROJECTILE

BACKGROUND OF THE INVENTION

This invention relates to rocket-propelled projectiles; and particularly to those of a long, tubular nature, capable of launching a series of bombs. This invention was made under or during the course of Contract Number DAAD05-73-C-0519 with the U.S. Army.

Bombs of the type described herein are known in the art, and have been launched from tubes fixed to the wings of military aircraft. These bombs are essentially explosive, shaped charges that are intended for use against armored vehicles such as tanks. The shaped charge of each bomb forms a conical recess in which an adjacent bomb may be nested. This is facilitated by shaping the drogue parachute attached to the opposite end of each bomb in the form of a cone protected by a conical shield, the bombs being arranged in tandem so that the conical shield of each bomb is nested in the conical, shaped charge of an adjacent bomb.

An aerodynamically actuated clip attaches the split shield to its bomb by means of a band that passes around the shield. One end of each clip is confined between its shield and the conical portion of an adjacent bomb so that, as each bomb is removed from the column of bombs by its opening parachute, the clip of the following bomb is released by the wind. Aerodynamic forces remove it, and the shield which it holds, so that the bomb parachute may be deployed.

With this method, an area containing armored vehicles is saturated with the bombs, with a relatively low hit probability. However, there is now a requirement that such bombs be launchable from helicopters and with a higher percentage of hits.

SUMMARY OF THE INVENTION

The present invention, which satisfies this need, includes an elongated tube, equipped at one end with a releasable nose cone. The tube contains bombs that are conical, shaped charges, conveniently nested together so that the parachute end of each bomb fits into the conical recess of an adjacent bomb. A main parachute housing adjoins the open end of the tube, and a conical partition separates the housing and tube. An adapter having a closed aft end is releasably connected to the aft end of the parachute housing; and a rocket motor is attached by screw threads to the adapter.

The adapter contains an acceleration actuated fuse, contiguous with a slowburning propellant charge which is ignitable thereby, that acts as a time delay device. This propellant charge adjoins an explosive charge that is detonated when the propellant charge has been consumed. A piston adjacent the explosive charge bears against the end of the parachute housing and separates this housing from the adapter and rocket motor on detonation of the explosive charge. This piston is also attached to the top of the main parachute that is enclosed in the parachute housing; so that, as the piston becomes exposed at high velocity to the atmosphere, it becomes a means for deploying the main parachute.

The main parachute is deployed immediately after separation of the rocket and its adapter from the protectile. The shock of sudden deceleration on the tube causes the column of bombs to break shear pins that hold the nose cone to the tube. The bombs then emerge from the forward end of the tube. As the last bomb emerges, its parachute is automatically deployed by the wind, breaking the last bomb free from the column of bombs in front of it. This allows an aerodynamic vane on the penultimate bomb to release the parachute thereof so that it is also deployed in the wind. Each bomb of the column is successively released in the same manner.

Objects of the invention are to provide a means for launching a column of small bombs against a distant target with a high hit probability; and means for launching such bombs from various sources, such as helicopters, foot soldiers, etc. Important features of the invention are that it is reliable and simple in construction.

Other objects and features of the invention may be noted as the following detailed description is read with reference to the accompanying drawings, wherein the same parts are designated by the same numbers throughout the disclosure.

DESCRIPTION OF THE PREFERRED EMBODIMENTS

Figure 1:
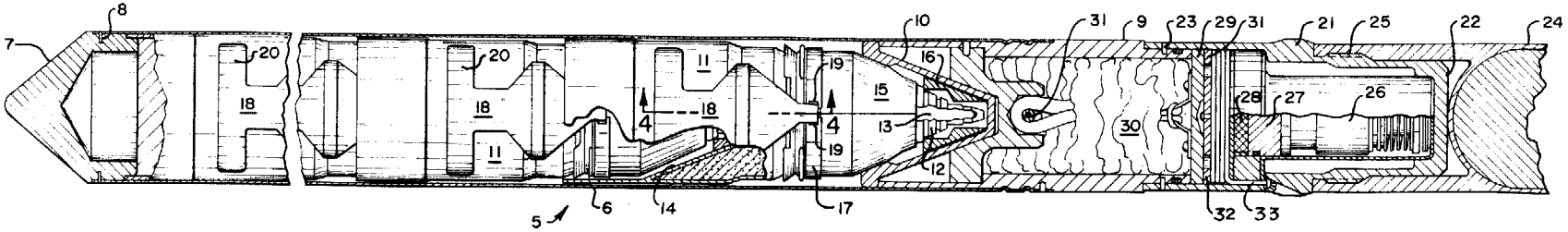
FIG. 1 is a longitudinal section of the invention with some parts broken away.
Figure 2:
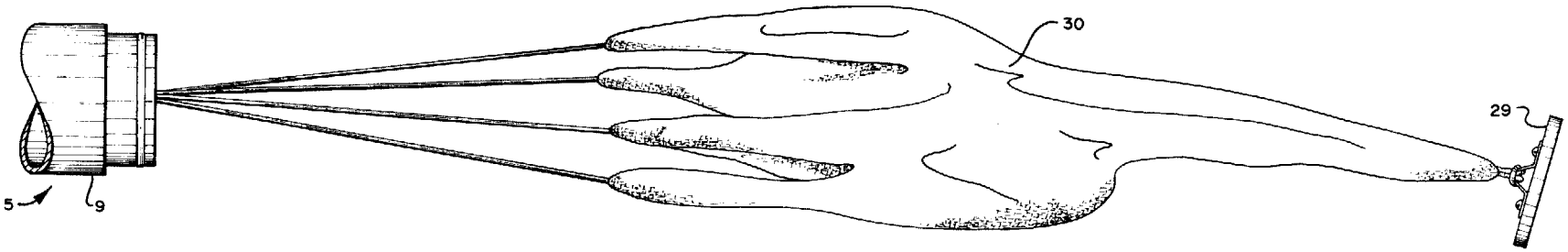
FIG. 2 is a fragmentary view showing the means for deploying the main parachute.
Figure 4:
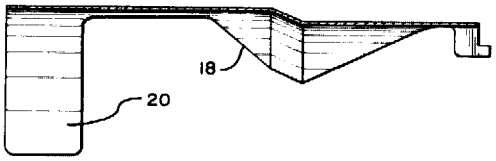
FIG. 4 is a sectional view of a clip, removed from the bombs, taken on line 4—4 of FIG. 1.
Figure 3:
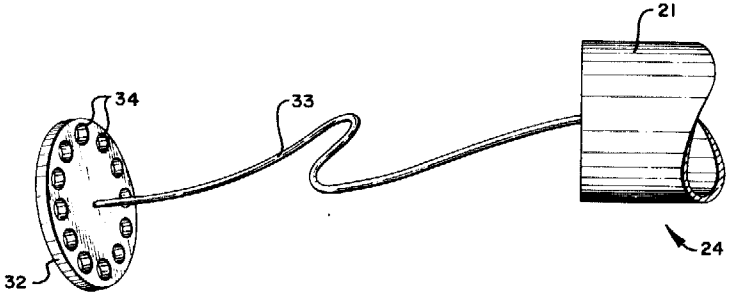
FIG. 3 is a fragmentary view showing a means for altering the trajectory of the spent rocket after its separation from the projectile.

The projectile 5 of the invention has an elongated tube 6 closed at one end by a nose cone 7 that is attached into the tube by shear pins 8. The main parachute housing 9 is attached to the aft end of the tube 6 and an aftwardly extending, conical partition 10 separates the tube 6 from the housing 9. The tube 6 is filled with a plurality of bombs 11 between the partition 10 and the nose cone 7.

Each bomb 11 is an explosive, conical, shaped charge having a proximity fuse 12 and a cruciform parachute 13 attached to the end of the bomb opposite the conical recess 14, which forms the shaped charge thereof. Each bomb 11 is also equipped with a thin conical, plastic shield 15, separated into two halves, that fits over and protects the parachute 13. When the bombs 11 are packaged in the tube 6, this shield fits into the conical recess of the adjacent bomb 11. In order to prevent damage to the shield 15 during periods of high acceleration, a conical spacer 16 is included between the parachute shield 15 of each bomb 11 and the recess of the adjacent bomb. The two halves of the shield 15 are held together by a flexible steel band 17 that is passed around them. Its ends are held together by a pronged, sheet metal clip 18, the prongs of which are inserted in slots 19 in the ends of the band 17. The band 17 and the aft end of the clip 18 are maintained in a closed position by confinement in the conical recess of the adjacent bomb 11; so that, when this adjacent bomb is removed, the aerodynamic vane 20 on the forward end of the clip 18 is caught in the wind. This tears the clip 18 from the band 17 to release the shield 15 and deploy the parachute 13.

An adapter 21, closed at its aft end 22, is attached by shear pins 23 to the aft end of the main parachute housing 9; and the rocket motor 24 is attached by screw threads 25 to the adapter 21. The adapter 21 contains an acceleration actuated fuse 26 that is ignited when the rocket motor achieves a predetermined rate of acceleration. A slow-burning propellant charge 27 adjacent the fuse 26 is ignited thereby and functions as a time delay device. When this propellant 27 is consumed, it detonates a contiguous explosive charge 28. A piston 29 adjacent the explosive charge 28, bears against the aft end of the main parachute housing 9 and forces this housing away from the adapter 21, breaking the shear pins 23 that hold the housing 9 to the adapter 21. This separates the adapter and its rocket motor from the projectile 5. The piston 29 is also attached at its center to the top of the main parachute 30, which is packaged in the housing 9 and attached therein to a lug 31 fixed to the sides of the housing. Hence, on separation of the rocket 24 and adapter 21 from the projectile 5, the piston 29 becomes exposed at high velocity to the atmosphere and serves as a means for deploying the main parachute 30.

A perforated disk 32 is centrally attached by a cable 33 to the wall of the adapter 21 and is packaged between the explosive charge 28 and the piston 29. On separation of the adapter 21 from the projectile 5, this perforated disk 32 is freed from the adapter 21 and is exposed at high speed to the atmosphere, where it functions as a drogue to alter the trajectory of the combined rocket 24 and adapter 21 and prevent their possible collision with the projectile 5. It is important to note that, because of the perforations 34, the disk 32 may be packaged between the explosive charge 28 and the piston 29 without appreciably interfering with exertion of explosive force on the piston 29 on detonation of the charge 28. However, enough of this force is intercepted to force the disk 32 from the adapter 21. Also, the size of the perforations 34 can be used to predetermine the desired drag force that will be exerted on the separated rocket 24.

A typical sequence of events on launch of the rocket motor 24 is: (1) the rocket motor has achieved sufficient acceleration to arm the fuse 26 after about 0.01 second; (2) the solid propellant rocket motor 24 has burned out after 1.5 seconds; (3) the fuse 26 ignites the time delay propellant 27 which burns for 10.5 seconds while the entire missile coasts toward the target; and (4) the explosive charge 28 then detonates, forcing the piston 29 to separate the projectile 5 from the rocket 24 and its adapter 21. On deployment of the main parachute 30, (which occurs immediately when the rocket and projectile are separated), the entire column of bombs 11 moves forward by its own inertia, because of the sudden deceleration of the tube 6, and shears off the pins 8 that hold the nose cone 7 to the tube 6. As the column of bombs 11 becomes free of the tube 6, the unprotected parachute 13 of the aft bomb 11 becomes deployed, separating this bomb from the column. This frees the clip 18 of the penultimate bomb 11, exposing its aerodynamic vane 20 to the wind and removing the clip 18 from its band 17. This in turn releases its shield 15 and parachute 13. Each successive bomb is thereupon released in the same manner.

This release of the column of bombs 11 typically occurs in the vicinity of the target, and the parachute 13 of each bomb 11 serves to orient the shaped charge thereof toward the possible target.

An invention has been described that advances the art of military projectiles. Although details of the embodiments have been described with considerable specificity, it should be noted that many such details may be varied without departing from the scope of the invention as it is defined in the following claims.

The invention claimed is:

1. A rocket-propelled projectile comprising:
an elongated projectile tube;
a nose cone releasably attached to the forward end of the tube;
a plurality of bombs in the tube;
a main parachute in the aft end portion of the tube and attached thereto;
a piston aft of the parachute and attached thereto;
a rocket releasably attached to the aft end of the projectile tube;
an acceleration-initiated fuse in the tube;
a means for producing gas, packaged between the piston and rocket and in communication with the fuse so that it may be ignited thereby to produce expanding gases that bear against the piston and the rocket to separate the projectile from the rocket, the piston becoming also a means for deploying the parachute by creating a drag thereon when the atmosphere engages the freed piston on separation of the projectile from the rocket.

2. The rocket-propelled projectile of claim 1 further including a disk, packaged between the rocket and projectile, attached by cable to the rocket such that, on separation of the rocket from the projectile, the disk becomes exposed at high speed to the atmosphere, whereby the trajectory of the spent rocket may be altered to avoid its possible collision with the projectile.

3. The rocket-propelled projectile of claim 2 wherein the disk is perforated and is packaged between the explosive charge and the piston, whereby: (1) explosive force from the detonated charge may act directly on the piston through the perforations, (2) the disk may be forced out of the adapter, and (3) the desired amount of drag exerted on the rocket by the disk may be achieved by size and number of the perforations.

4. The projectile of claim 1 wherein each bomb is an explosive, shaped charge having a conical recess in the forward end thereof, and further includes:
a parachute attached to the aft end of the bomb;
a shield that fits over the parachute and into the conical recess of the adjacent bomb, comprising two hollow, half cones, a band holding them together to form a full cone, and a pronged clip, the prongs of which fit into slots in the ends of the band to fasten it about the shield, the prongs of the clip being maintained in the slots of the band by confinement of the band and clip between the shield and the conical recess of the adjacent bomb, and the clip functioning also as an aerodynamic vane, whereby removal of the adjacent bomb allows the wind to remove the clip from the band, releasing the shield and allowing the parachute to be deployed.

5. A rocket-propelled projectile comprising:
an elongated tube;
a nose cone releasably attached to one end of the tube;
a series of bombs in the tube wherein each bomb comprises a conical, shaped, explosive charge having a parachute and means for deploying the parachute;
conical spacers between the bombs for orderly packaging thereof;
a cylindrical housing fixed to the aft end of the tube;
a partition between the tube and the housing;

a cylindrical adapter closed at its aft end and releasably attached on the aft end of the housing;

a rocket motor engagable by screw threads to the adapter;

an acceleration-initiated fuse in the adapter;

a time delay charge contiguous with the fuse and ignitable thereby;

an explosive charge adjacent the time delay charge;

a piston confined between the explosive charge and the end of the housing, whereby detonation of the explosive charge may force the piston against the housing to separate it from the adapter and the rocket motor;

a parachute attached to the housing and packaged therein, the top portion of the parachute being attached to the piston, so that, when the piston becomes exposed at high speed to the atmosphere on separation of the adapter from the housing, the piston may also function as a means for deploying the parachute; and a perforated disk packaged between the explosive charge and the piston and operably attached by cable to the rocket, so that it may function as a drogue to alter the trajectory of the spent rocket on separation thereof from the projectile.

* * * * *